US008764376B2

(12) United States Patent
Lei et al.

(10) Patent No.: US 8,764,376 B2
(45) Date of Patent: Jul. 1, 2014

(54) DIFFUSER DIVIDER

(75) Inventors: Vai Man Lei, Torrance, CA (US); Glenn F. Thompson, Palo Verdes Estates, CA (US)

(73) Assignee: Honeywell International Inc., Morristown, NJ (US)

( * ) Notice: Subject to any disclaimer, the term of this patent is extended or adjusted under 35 U.S.C. 154(b) by 491 days.

(21) Appl. No.: 13/108,887

(22) Filed: May 16, 2011

(65) Prior Publication Data

US 2012/0294703 A1 Nov. 22, 2012

(51) Int. Cl.
*F01D 1/06* (2006.01)

(52) U.S. Cl.
USPC ..... 415/101; 415/208.1; 415/211.2; 416/184; 416/185

(58) Field of Classification Search
USPC ..... 415/208.1, 208.2, 208.3, 211.2, 93, 97, 415/98, 99, 101, 102, 914; 416/198 R, 199, 416/198 A, 184, 185, 186 R, 187, 223 B
See application file for complete search history.

(56) References Cited

U.S. PATENT DOCUMENTS 4,530,639 A * 7/1985 Mowill ..... 415/98
2004/0170495 A1* 9/2004 Vogiatzis ..... 415/163

FOREIGN PATENT DOCUMENTS

RU 2414629 C2 * 10/2010 ..... F04D 29/44

* cited by examiner

*Primary Examiner* — Edward Look
*Assistant Examiner* — Juan G Flores
(74) *Attorney, Agent, or Firm* — Brian J. Pangrle

(57) ABSTRACT

A diffuser divider shaped as disc with a central axis, a leading edge disposed at an inner radius about the central axis, a trailing edge disposed at an outer radius about the central axis, an upper surface disposed between the leading edge and the trailing edge, a lower surface disposed between the leading edge and the trailing edge and one or more mounting features configured to mount the disc in a diffuser section configured to receive air compressed by two compressor wheel faces and to direct the compressed air to a volute. Such a divider can define throats in a diffuser section of a compressor assembly. Various other examples of devices, assemblies, systems, methods, etc., are also disclosed.

19 Claims, 9 Drawing Sheets

DIFFUSER DIVIDER

TECHNICAL FIELD

Subject matter disclosed herein relates generally to compressor assemblies, for example, turbomachinery compressor assemblies for internal combustion engines.

BACKGROUND

Turbochargers are frequently utilized to increase performance of an internal combustion engine. A turbocharger can extract energy from an engine's exhaust via a turbine to drive a compressor that compresses intake air directed to the engine. Turbochargers typically rely on a radial or centrifugal compressor wheel or wheels. A single compressor wheel may have a single face or two faces (e.g., arranged back to back). In general, intake air is received at an inducer portion of a face and discharged radially at an exducer portion. The discharged air is then directed to a volute, usually via a diffuser section.

A compressor may be characterized by a compressor flow map. A compressor flow map (e.g., a plot of pressure ratio versus mass air flow) can help characterize performance of a compressor. In a flow map, pressure ratio is typically defined as the air pressure at the compressor outlet divided by the air pressure at the compressor inlet. Mass air flow may be converted to a volumetric air flow through knowledge of air density or air pressure and air temperature.

Various operational characteristics define a compressor flow map. One operational characteristic of a compressor is commonly referred to as a surge limit, while another operational characteristic is commonly referred to as a choke area. A map may be considered as presenting an operating envelope between a choke area or line and a surge area or line.

Choke area results from limitations associated with the flow capacity of the compressor stage. In general, compressor efficiency falls rapidly as the local Mach number in the gas passage approaches unity. Thus, a choke area limit typically approximates a maximum mass air flow.

A surge limit represents a minimum mass air flow that can be maintained at a given compressor wheel rotational speed. Compressor operation is typically unstable in this area. Strong fluctuation in pressure and flow reversal can occur in this area, hence continuous operation is not desirable.

In general, compressor surge stems from flow instabilities that may be initiated by aerodynamic stall or flow separation in one or more of compressor components (e.g., as a result of exceeding a limiting flow incidence angle to compressor blades or exceeding a limiting flow passage loading).

For a turbocharged engine, compressor surge may occur when the engine is operating at high load or torque and low engine speed, or when the engine is operating at a low engine speed with a high rate of exhaust gas recirculation (e.g., EGR). Compressor surge may also occur when a relatively high specific torque output is required of an engine with a variable nozzle turbine (VNT) or an electrically assisted turbocharger. Additionally, surge may occur when a rapid intake air boost is initiated using an electric motor or VNT mechanism, or when an engine is suddenly decelerated (e.g., consider a closed throttle valve while shifting gears).

Various technologies described herein pertain to compressor assemblies where, for example, one or more components can widen a compressor map by delaying surge.

BRIEF DESCRIPTION OF THE DRAWINGS

A more complete understanding of the various methods, devices, assemblies, systems, arrangements, etc., described herein, and equivalents thereof, may be had by reference to the following detailed description when taken in conjunction with examples shown in the accompanying drawings where.

DETAILED DESCRIPTION

Figure 1:
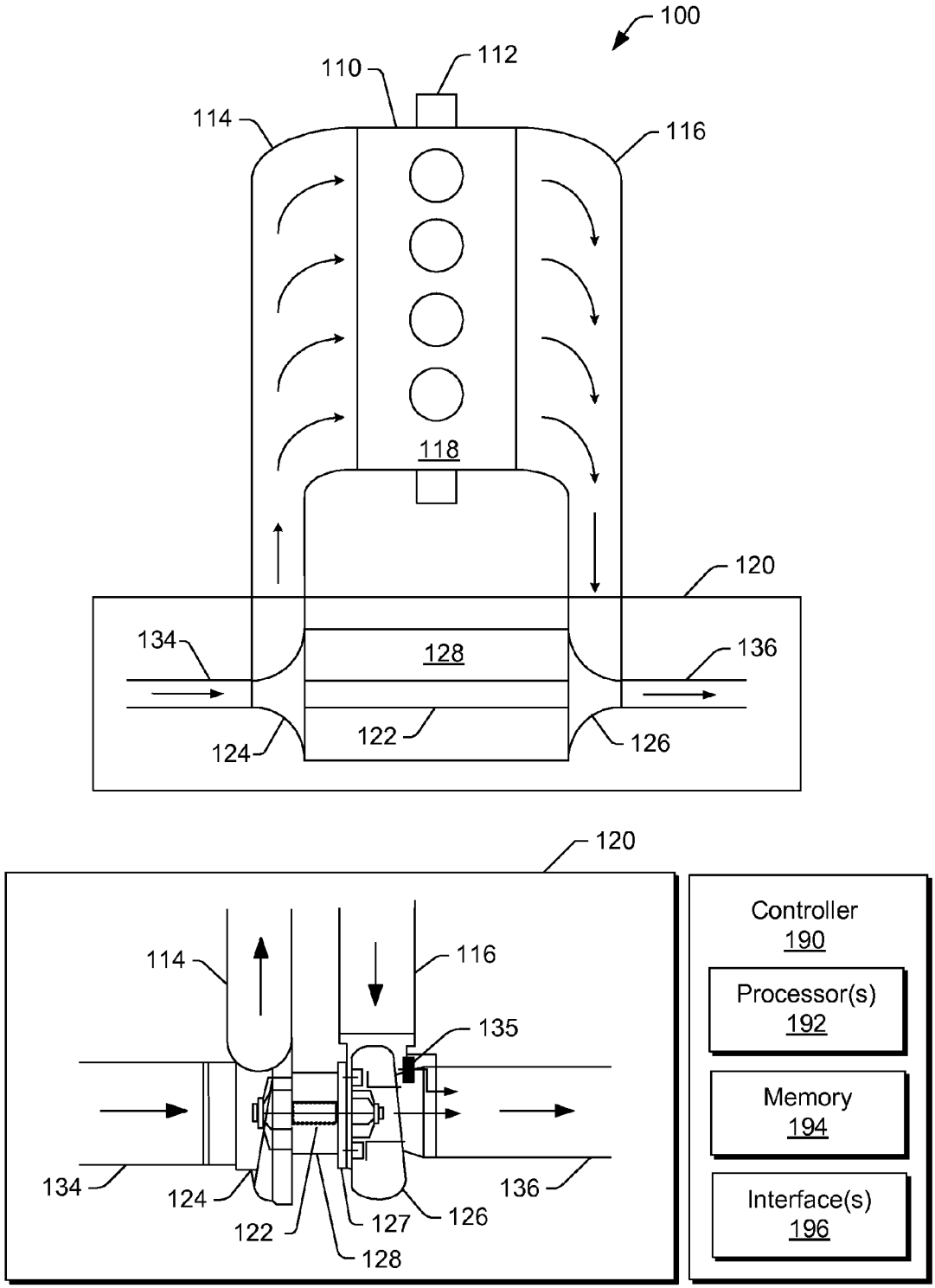
FIG. 1 is a diagram of a turbocharger and an internal combustion engine along with a controller.

In various examples, a compressor assembly includes a divider positioned at least partially in a diffuser section. Such a divider can create two throats where, for an assembly with back-to-back compressor wheel faces, one throat receives an air stream via an exducer of one face, and the other throat receives an air stream via an exducer of the other face. As described herein, a divider can relocate the point where mixing of two air streams occurs. For example, where a leading edge of a divider is positioned proximate to an outer circumference of a dual-faced compressor wheel, each exducer air stream travels radially outward in a respective throat until the throats join (e.g., at a trailing edge of a divider). As cross-sectional flow area of a diffuser section typically increases with increasing radial position (e.g., as measured from a rotational axis of a wheel), mixing can occur at a lower radial velocity, which tends to be beneficial to efficiency. As described herein, a divider may span a portion of a diffuser section, the entire length of a diffuser section, or even beyond an end of a diffuser section (e.g., consider a trailing edge positioned in a volute). Such a divider can be beneficial to flow stability.

As shown in various plots based on trial data, a diffuser divider can allow a dual-faced compressor wheel to operate stably at a lower flow rate. For a trial example, inclusion of a divider was able to substantially delay surge. Depending on desired performance, cross-sectional area of a diffuser section may be tailored to account for the presence of a divider, for example, by increasing axial spacing between walls that define a diffuser section. Such tailoring may account, at least in part, for reduction in efficiency due to an increase in wetted flow area associated with a divider. As described herein, a divider may be tailored (e.g., length, thickness, shape, mounting mechanism, etc.) to reduce impact on compressor efficiency.

In general, a turbocharger with a compressor featuring a double sided wheel can have benefits over a conventional wheel. Such benefits can include: reduced compressor size leading to lower rotor group inertia and better transient response; reduced package volume; and improved speed matching with a turbine to lead to improved turbine efficiency. As mentioned, a wide compressor map can be beneficial, especially for installations that use high exhaust gas recirculation (EGR) rate to meet emissions targets. As described herein, a divider can increase width of a map for a compressor with a double faced wheel.

As described herein, a double faced wheel may be operated using one or both faces. Where both faces provide for compression of intake air to a common volute, some interaction of exducer air streams occurs, which can be detrimental to system stability. As described herein, a divider can at least partially isolate two exducer air streams, and cause their interaction to happen further downstream of the exducer region. Such relocation of a mixing or interaction region can improve stability and delay surge.

While various examples pertain to a vaneless diffuser section, a compressor assembly with vanes may optionally include a divider located upstream or downstream of the vanes. Another configuration may optionally include vane and divider overlap. For example, consider vanes disposed in one or two throats defined by a divider.

As described herein, a divider may be mounted in a diffuser section of a compressor assembly by any of a variety of mechanisms or arrangements. Various components may optionally be provided as a kit. For example, a kit may include a divider ring or disc, spacers and bolts where the spacers set the axial location of the divider within a diffuser and where the spacers are secured to a component of a compressor assembly (e.g., diffuser wall, etc.) via the bolts. As described herein, in the foregoing example or other, spacers or other mounting equipment may be non-evenly spaced to minimize the risk of compressor wheel high cycle fatigue (HCF).

Below, an example of a turbocharged engine system is described followed by various examples of components, assemblies, methods, etc.

Turbochargers are frequently utilized to increase output of an internal combustion engine. Referring to FIG. 1, a conventional system 100 includes an internal combustion engine 110 and a turbocharger 120. The internal combustion engine 110 includes an engine block 118 housing one or more combustion chambers that operatively drive a shaft 112 (e.g., via pistons). As shown in FIG. 1, an intake port 114 provides a flow path for air to the engine block 118 while an exhaust port 116 provides a flow path for exhaust from the engine block 118.

The turbocharger 120 acts to extract energy from the exhaust and to provide energy to intake air, which may be combined with fuel to form combustion gas. As shown in FIG. 1, the turbocharger 120 includes an air inlet 134, a shaft 122, a compressor 124, a turbine 126, a housing 128 and an exhaust outlet 136. The housing 128 may be referred to as a center housing as it is disposed between the compressor 124 and the turbine 126. The shaft 122 may be a shaft assembly that includes a variety of components (e.g., bearings, etc.). While the example of FIG. 1 shows the compressor 124 with a single faced compressor, other arrangements are possible such as a double faced compressor wheel configured with back-to-back faces where an inducer portion of each face can be provided with intake air.

In the example of FIG. 1, a variable geometry mechanism 127 provides for adjusting flow of exhaust to the turbine 126 and a wastegate valve (or simply wastegate) 135 is positioned proximate to the inlet of the turbine 126. The variable geometry mechanism 127 may include controllable vanes while the wastegate valve 135 may be controllable to allow exhaust from the exhaust port 116 to bypass the turbine 126. In combination, such features may provide for control of turbocharger dynamics.

In FIG. 1, an example of a controller 190 is shown as including one or more processors 192, memory 194 and one or more interfaces 196. Such a controller may include circuitry such as circuitry of an engine control unit. As described herein, various methods or techniques may optionally be implemented in conjunction with a controller, for example, through control logic. Control logic may depend on one or more engine operating conditions (e.g., turbo rpm, engine rpm, temperature, load, lubricant, cooling, etc.). For example, sensors may transmit information to the controller 190 via the one or more interfaces 196. Control logic may rely on such information and, in turn, the controller 190 may output control signals to control engine operation. The controller 190 may be configured to control flow to one or more compressor wheel faces, flow from one or more compressor wheel faces, lubricant flow, temperature, a variable geometry assembly (e.g., variable geometry compressor or turbine), a wastegate, an electric motor, or one or more other components associated with an engine, a turbocharger (or turbochargers), etc.

Figure 2:
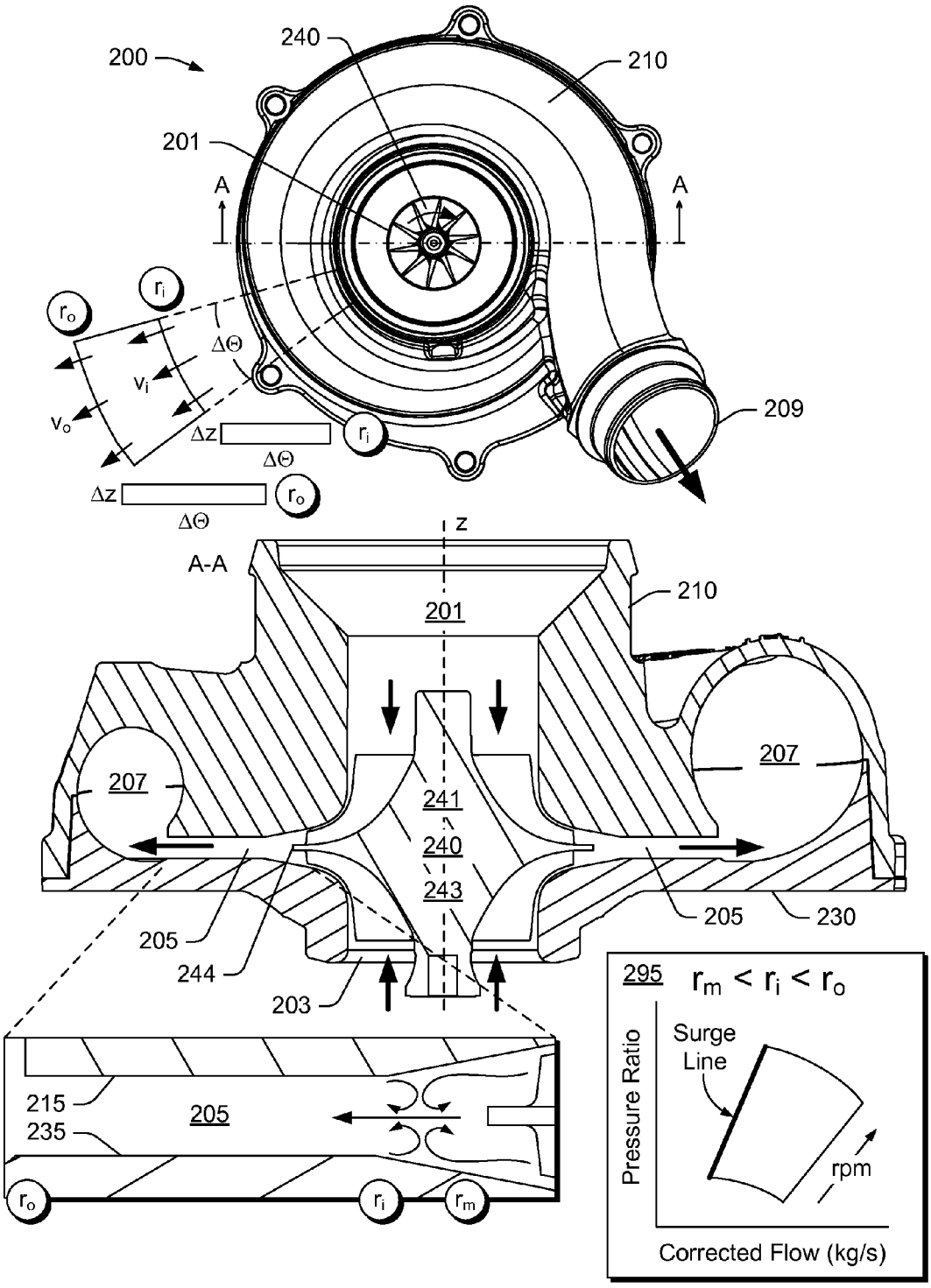
FIG. 2 is a top view and a cross-sectional view of an example of a compressor assembly along with a compressor map.

FIG. 2 shows an example of a compressor assembly 200 along with a plot 295. Specifically, FIG. 2 shows a top view, a cross-sectional view along a line A-A, and an enlarged view of a portion of the compressor assembly 200. The compressor assembly 200 includes a housing component 210, a housing component 230 and a wheel 240 with a face 241, a face 243 and an outer circumferential edge 244. An opening 201 of the component 210 provides for receipt of air (e.g., optionally mixed with exhaust) to an inducer portion of the face 241 and an opening 203 of the component 230 provides for receipt of air (e.g., optionally mixed with exhaust) to an inducer portion of the face 243. Upon rotation of the wheel 240, exducer portions of the faces 241 and 243 direct air to a diffuser section 205 and to a volute 207. In the example of FIG. 2, the components 210 and 230 define the volute 207, which is a common volute configured to receive air from the faces 241 and 243, while the component 210 defines a volute opening 209.

As shown in the enlarged view, the diffuser section 205 is formed from a wall 215 of the component 210 and a wall 235 of the component 230. The diffuser section 205 may be considered as having a length extending between an inlet disposed at a radius r, and an outlet disposed at a radius $r_o$ (e.g, as measured from a central axis z). As shown in the top view, the cross-sectional area (see, e.g., $\Delta\Theta$ by $\Delta z$) of the diffuser section 205 is greater at the radius $r_o$ than at the radius $r_i$. Accordingly, velocity of air traveling in the diffuser section typically decreases with respect to increasing radius.

The enlarged view also shows a mixing radius $r_m$, where air streams from the two exducers can mix. In the example of FIG. 2, the mixing radius $r_m$, is less than the inlet radius $r_i$; therefore, at least some mixing occurs prior to the inlet of the diffuser section 205 (e.g., as defined by $r_i$). The plot 295 shows an operational envelope of pressure ratio versus corrected flow for various compressor wheel rotational speeds. The left hand side of the envelope is defined by a surge line, which as mentioned, represents a limit as to performance.

Figure 3:
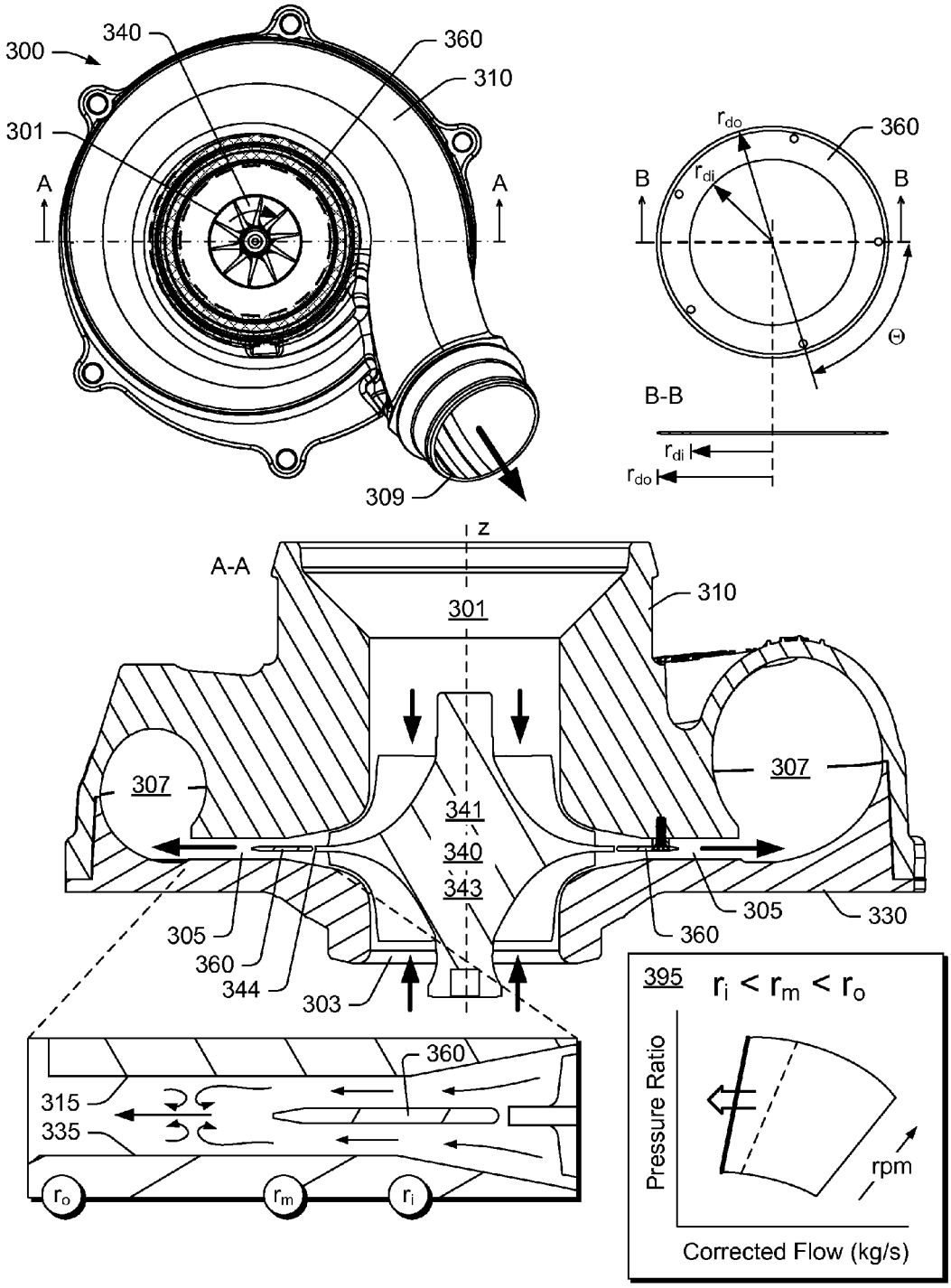
FIG. 3 is a top view and a cross-sectional view of an example of a compressor assembly along with a compressor map where the compressor includes a diffuser divider.

FIG. 3 shows an example of a compressor assembly 300, an example of a divider 360 and a plot 395. Specifically, FIG. 3 shows a top view, a cross-sectional view along a line A-A, and an enlarged view of a portion of the compressor assembly 300 as well as a top view and a cross-sectional view along a line B-B of the divider 360.

The compressor assembly 300 includes a housing component 310, a housing component 330, the divider 360, and a wheel 340 with a face 341, a face 343 and an outer circumferential edge 344. An opening 301 of the component 310 provides for receipt of air (e.g., optionally mixed with exhaust) to an inducer portion of the face 341 and an opening 303 of the component 330 provides for receipt of air (e.g., optionally mixed with exhaust) to an inducer portion of the face 343. Upon rotation of the wheel 340, exducer portions of the faces 341 and 343 direct air to a diffuser section 305 divided by the divider 360 and to a volute 307. In the example of FIG. 3, the components 310 and 330 define the volute 307, which is a common volute configured to receive air from the faces 341 and 343, while the component 310 defines a volute opening 309.

As shown in the enlarged view, the diffuser section 305 is formed from a wall 315 of the component 310 and a wall 335 of the component 330. The diffuser section 305 may be considered as having a length extending between an inlet disposed at a radius $r_i$ and an outlet disposed at a radius $r_o$. As mentioned, velocity of air traveling in the diffuser section typically decreases with respect to increasing radius (e.g., due to increasing cross-sectional area).

In the example of FIG. 3, the divider 360 overlaps at least a portion of the length of the diffuser section where a leading edge is positioned proximate to the outer edge 344 of the wheel 340 and where a trailing edge is positioned between the radii r, and $r_o$. As shown in the enlarged view, the trailing edge of the divider 360 defines a mixing radius $r_m$ where air streams from the two exducers can mix. In the example of FIG. 3, the mixing radius $r_m$ is greater than the inlet radius $r_i$ and less than the outlet radius $r_o$. In other words, the mixing radius as defined by the trailing edge of the divider 360 is positioned between the inlet radius r, and the outlet radius $r_o$ (or the volute 307). Therefore, mixing occurs primarily downstream of the inlet of the diffuser section 305 (e.g., as defined by $r_i$). The plot 395 shows an operational envelope of pressure ratio versus corrected flow for various compressor wheel rotational speeds. The left hand side of the envelope is defined by a surge line, which as mentioned, represents a limit as to performance. A dashed line indicates the surge line for a compressor assembly such as the assembly 200 of FIG. 2 while a solid line indicates the surge line for a compressor assembly such as the assembly 300 of FIG. 3, which includes a divider.

Referring again to the top view of the divider 360, an inner divider radius $r_d$, and an outer divider radius $r_{do}$ are shown, which coincide with leading and trailing edges of the divider 360, respectively. An angle Θ is shown as defining a position of a mounting feature to mount the divider 360 to the component 310. As mentioned, to reduce HCF, mounting features may be arranged asymmetrically or unevenly.

Figure 4:
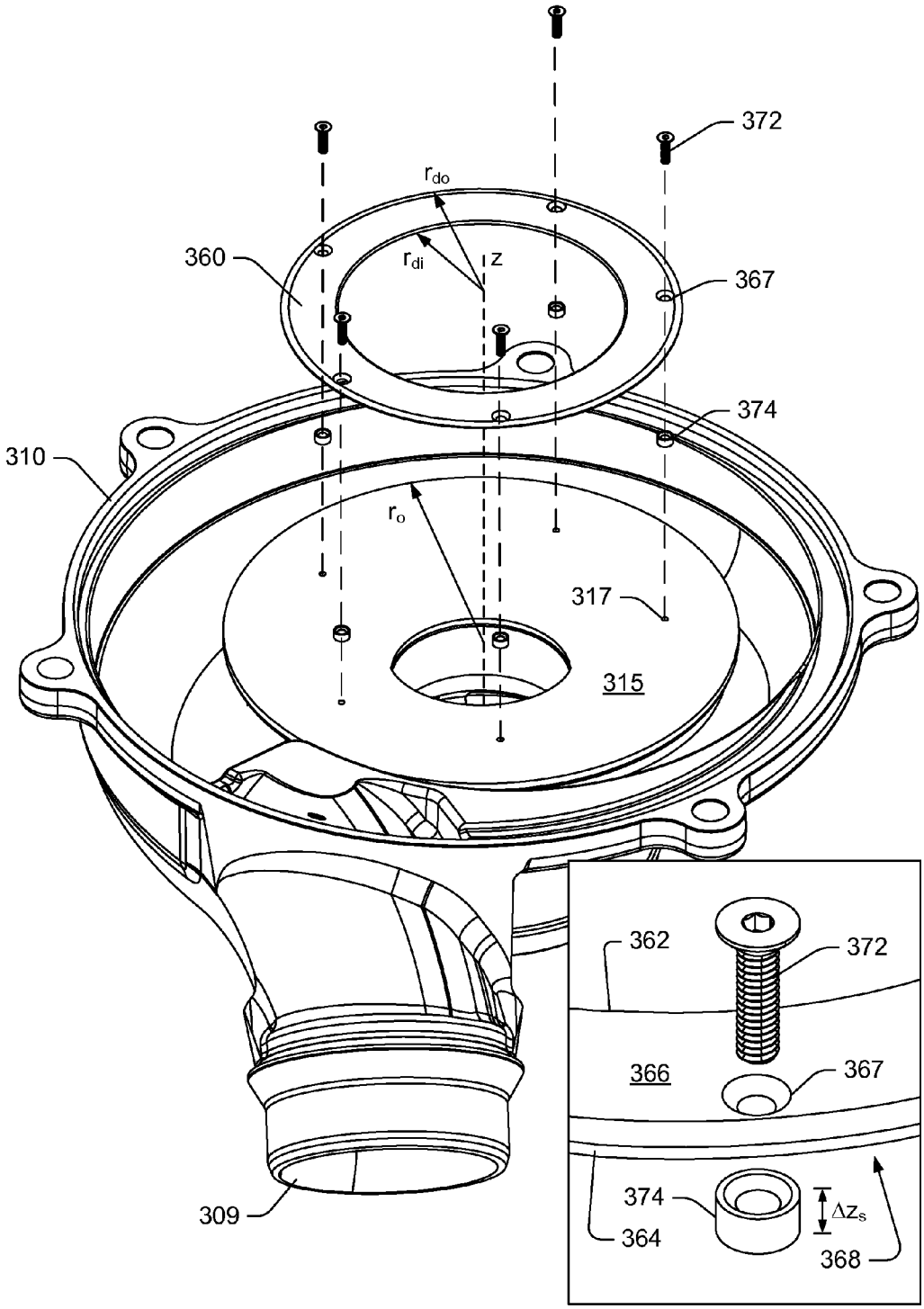
FIG. 4 is an exploded perspective view of various components of the compressor assembly of FIG. 3.

FIG. 4 shows an exploded view and an enlarged view of various components of the assembly 300 of FIG. 3. In the example of FIG. 4, the component 310 includes various threaded openings 317 located along the diffuser wall 315. Mounting components include threaded bolts 372 and spacers 374. Each of the spacers 374 have an axial dimension $\Delta z_s$ to determine, at least in part, an axial position or axial spacing of the divider 360 with respect to the diffuser wall 315.

In the example of FIG. 4, the disc shaped divider 360 includes a central axis (e.g., z-axis), a leading edge 362 disposed at an inner radius $r_{di}$ about the central axis, a trailing edge 364 disposed at an outer radius $r_{do}$ about the central axis, an upper surface 366 disposed between the leading edge 362 and the trailing edge 364, a lower surface 368 disposed between the leading edge 362 and the trailing edge 364 and one or more mounting features 367 configured to mount the divider 360 in a diffuser section configured to receive air compressed by two compressor wheel faces and to direct the compressed air to a volute.

Figure 5:
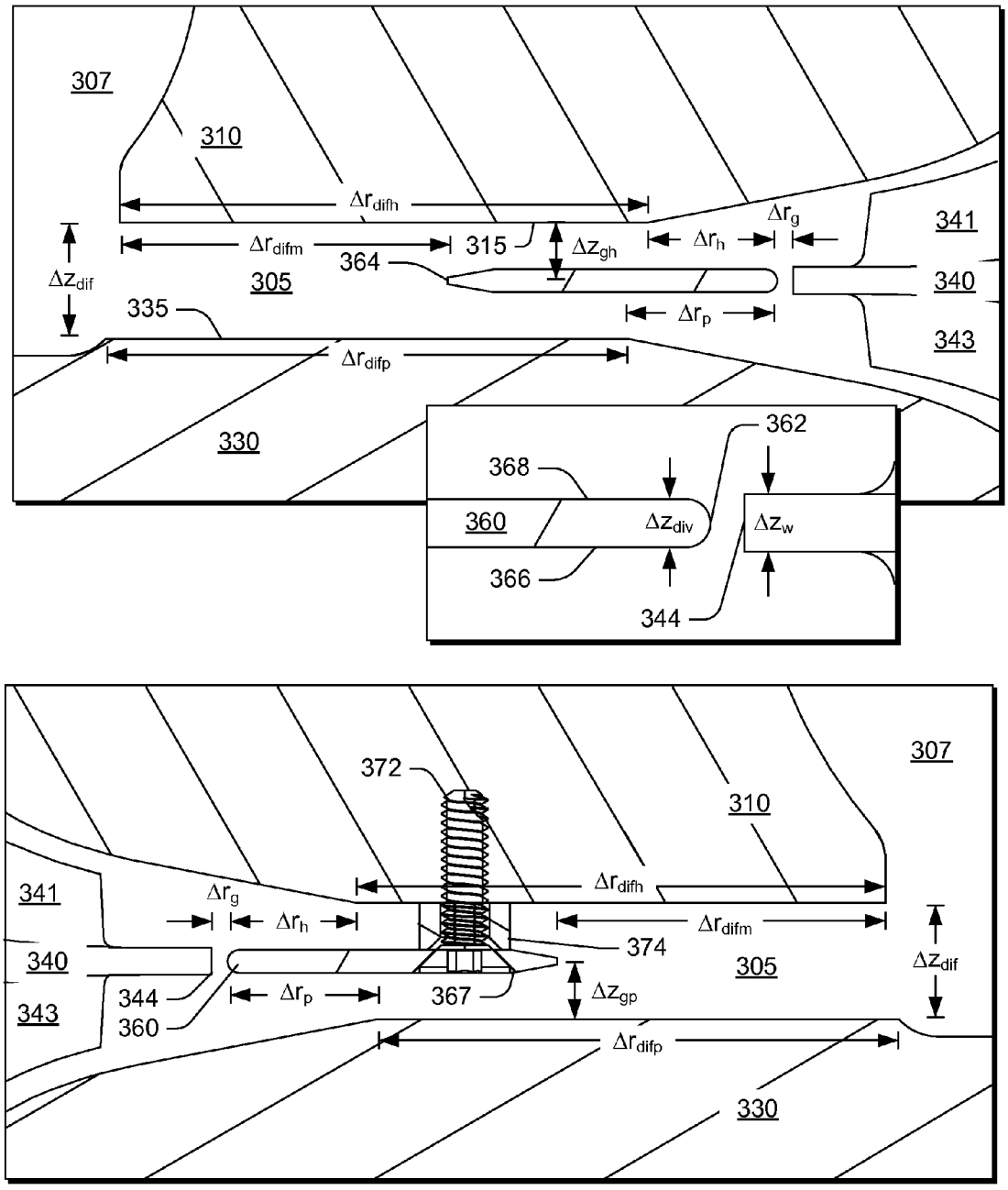
FIG. 5 is a series of views of diffuser sections of the compressor assembly of FIG. 3 where a diffuser divider defines throats.

FIG. 5 shows enlarged cross-sectional views of portions of the assembly 300 of FIG. 3. One of the cross-sectional views shows the mounting feature 367 of the divider 360 as being a tapered aperture configured to flushly seat the bolt 372 (e.g., optionally with a tapered head) with respect to the surface 366 (e.g., to minimize flow disruption across the mounting component or mechanism). As described herein, various mounting components may be shaped, sized, etc., to minimize flow disruption or, in general, resistance to flow in a diffuser section. For example, the spacer 374 may be shaped to minimize flow disruption (e.g., flat, cylindrical, elliptical, tear-drop, etc.). As described herein, mounting features may be extensions extending from a wall or a divider, such extensions may be welded or otherwise fixed or fixable for positioning a divider. As described herein, a surface may be a mounting feature, for example, to which another feature may be attached (e.g., welded, bonded, etc.).

Various dimensions are shown in FIG. 5 including radial dimensions and axial dimensions. As described herein, an assembly may have dimensions other than those shown in FIG. 5. With respect to the divider 360, $\Delta z_{div}$ represents a thickness, which may be compared or matched to a thickness $\Delta z_w$ of the outer edge 344 of the wheel 340. A radial gap $\Delta r_g$ exists between the outer edge 344 of the wheel 340 and the leading edge 362 of the divider 360.

As shown in FIG. 5, the diffuser wall 315 may differ from the diffuser wall 335. For example, the length of the wall 315 $\Delta r_{difh}$ may be offset from the length of the wall 335 $\Delta r_{difp}$. Accordingly, the two throats defined by the divider 360 and the walls 315 and 335 may differ (e.g., one may be longer, etc., than the other). For example, consider dimensions $\Delta r_h$, $\Delta r_p$, and $\Delta r_{difm}$. Other dimensions include an axial diffuser dimension $\Delta z_{dif}$ and a gap from the wall 315 $\Delta z_{gh}$ as well as a gap from the wall 335 $\Delta z_{gp}$. As described herein, the component 310 may be considered a housing ("h") while the component 330 may be considered a plate ("p"). As shown in various examples, upon assembly, the components 310 and 330 house the double faced wheel 340.

Figure 6:
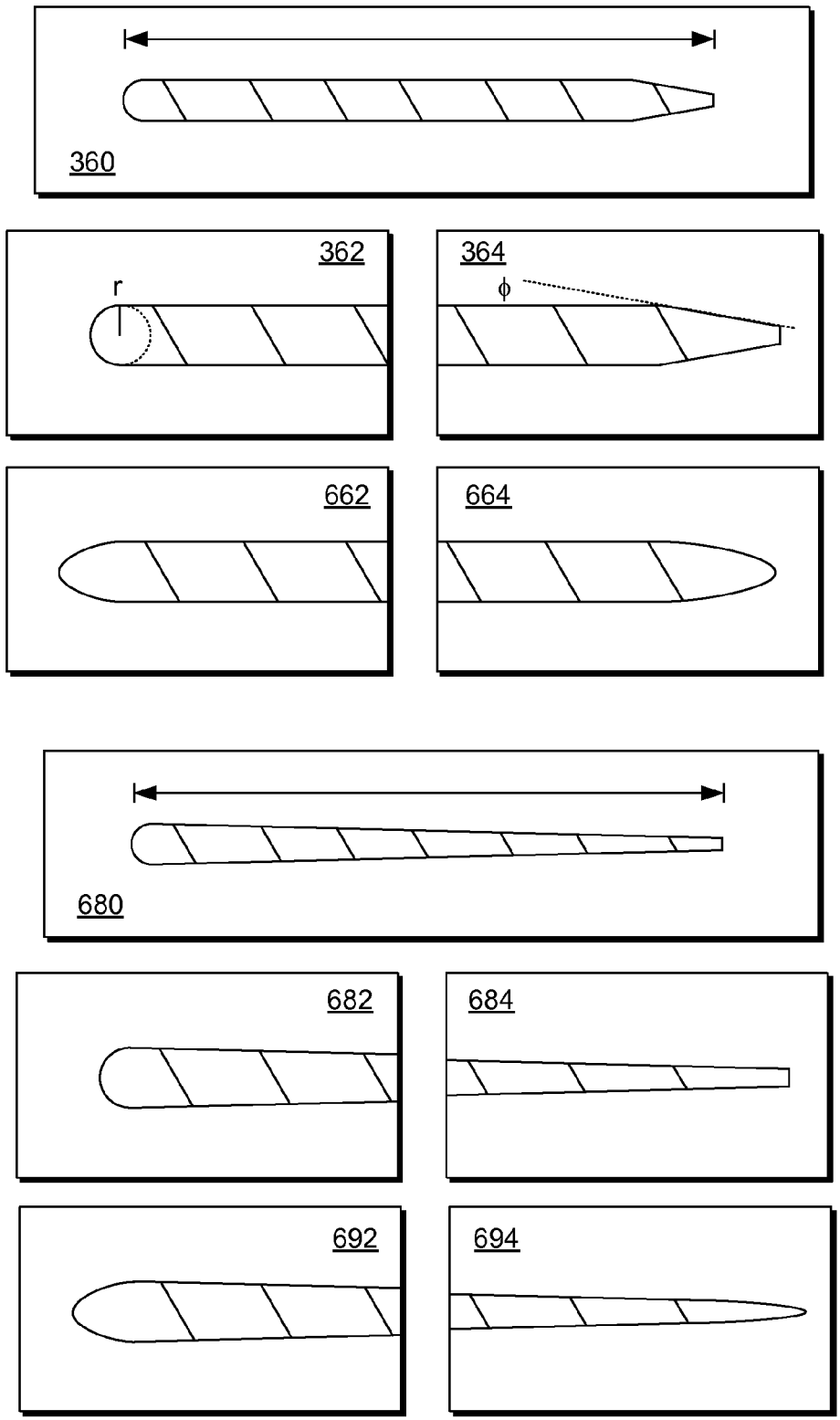
FIG. 6 is a series of views of examples of a diffuser divider.

FIG. 6 shows various cross-sectional views of some examples of dividers. As described herein, a divider may be defined by a length and a thickness as well as a leading edge profile and a trailing edge profile. The divider 360 can include a radiused profile defined by a radius r at its leading edge 362 or a profile with a different shape 662. The divider 360 can include a tapered profile defined by a taper angle ϕ at its trailing edge 364 or a profile with a different shape 664.

As described herein, between a leading edge profile and a trailing edge profile, a divider may have parallel upper and lower surfaces or upper and lower surfaces that are not parallel or a combination of parallel and non-parallel surfaces.

FIG. 6 shows an example of a divider 680 with upper and lower surfaces that converge from a larger thickness to a thinner thickness along a direction from a leading edge to a trailing edge. The overall profile of the divider 680 may be akin to an airfoil, with or without lift generation. In the example of FIG. 6, the divider 680 may have a radiused profile defined by a radius r at its leading edge 682 or a profile with a different shape 692. The divider 680 can include a tapered profile defined by a taper angle at its trailing edge 684 (e.g., where the taper optionally extends from a leading edge profile) or a profile with a different shape 694.

As described herein, a divider may be a single component or multiple components. For example, a divider may be provided as several components where each component spans a portion of an arc (e.g., consider three components that span 120 degrees). A divider may be provided as a single component or multiple components that do not span 360 degrees. A divider may be a portion of an annular disc with a gap between ends. As described herein, a divider may include aerodynamic features such as holes, slots, surface indicia, scallops, vanes, etc. Such features may be at an edge, at an upper surface, at a lower surface, extending between edges, extending between an edge and a surface, extending between two surfaces, etc.

In a particular example, a divider has a thickness of about 1 mm. Such a divider may have a leading edge with a radiused profile (e.g., radius of about 0.5 mm). As described herein, a tapered profile of a trailing edge may have a taper angle selected from a range of about 5 degrees to about 15 degrees.

Figure 7:
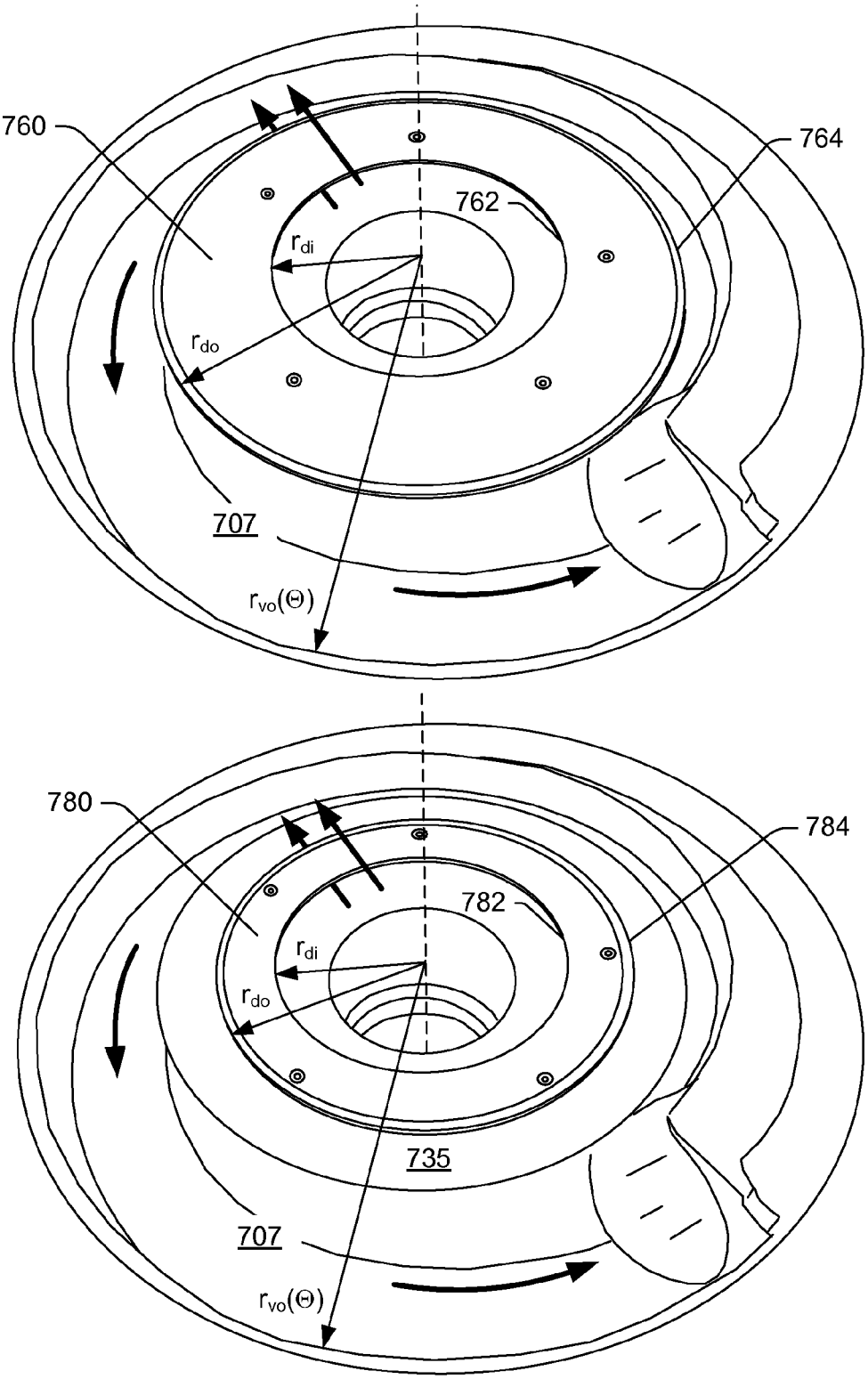
FIG. 7 is a perspective view of an example of an assembly that includes a diffuser divider that spans a significant portion of a diffuser section and an example of an assembly that includes a diffuser divider that spans a lesser portion of a diffuser section.

FIG. 7 shows perspective views of examples of dividers 760 and 780 with respect to a volute 707 where the divider 760 has a greater radial length than the divider 780. In FIG. 7, the radial length of each of the dividers 760 and 780 is defined as being between a radius $r_d$, at a leading edge 762 and 782 and a radius $r_{do}$ at a trailing edge 764 and 784. As described herein, one or more characteristics of a divider may be selected based on a wheel, a housing, a diffuser wall, a volute, etc. For example, one or more dimensions of a diffuser wall 735 may be relied on when selecting a divider, one or more dimensions of a volute 707 may be relied on when selecting a divider, etc. While various examples show a divider with a substantially constant inner radius or outer radius, as described herein, a divider may optionally include an inner radius, an outer radius or an inner radius and an outer radius that vary with respect to angle (e.g., Θ) about a central axis. As shown in FIG. 7, the volute 707 varies with respect to angle Θ about a central axis. As described herein, one or more dimensions of a divider may optionally vary in a manner dependent on variation in a volute.

As described herein, a divider may be a disc with a curved leading edge profile, a tapered trailing edge profile or a curved leading edge and a tapered trailing edge profiles. As described herein, a divider may include an upper surface and a lower surface that are substantially parallel surfaces. As described herein, a divider may include an axial distance between an upper surface and a lower surface that decreases with respect to increasing radial position (e.g., from leading edge to trailing edge).

As described herein, a divider may include one or more mounting features such as one or more openings. As described herein, one or more mounting features may be axial openings disposed unevenly about a central axis. A divider may optionally include one or more separate or integrated components for spacing the divider axially in a diffuser section. For example, an assembly may include one or more spacers to axially space a disc shaped divider in a diffuser section.

As described herein, a trailing edge of a divider may define a mixing boundary for mixing of air pressurized by a first compressor wheel face and air pressurized by a second compressor wheel face.

As described herein, an assembly can include a disc (e.g., a divider) that includes a central axis, a leading edge disposed at an inner radius about the central axis, a trailing edge disposed at an outer radius about the central axis, an upper surface disposed between the leading edge and the trailing edge, a lower surface disposed between the leading edge and the trailing edge; a diffuser wall extending between a compressor wheel shroud wall and a volute wall; and one or more mounting components to mount the disc an axial distance from the diffuser wall. In such an example, the disc may include openings, where the one or more mounting components may be bolts, and where the diffuser wall includes openings, each opening configured to receive a respective bolt. As mentioned, mounting features may be arranged or configured to reduce HCF. For example, openings of a disc may be spaced unevenly about a central axis.

As described herein, an assembly can include spacers configured to space the disc the axial distance from the diffuser wall. An assembly may include another diffuser wall (e.g., a second diffuser wall) where the walls define a diffuser section.

As described herein, an upper surface of a disc and a diffuser wall can define a first throat and a lower surface of a disc and a second diffuser wall can define a second throat. In such an example, the first throat can be configured to receive air compressed by a first compressor wheel face and the second throat can be configured to receive air compressed by a second compressor wheel face. An assembly may include a compressor wheel with a first compressor wheel face and a second compressor wheel face.

Figure 8:
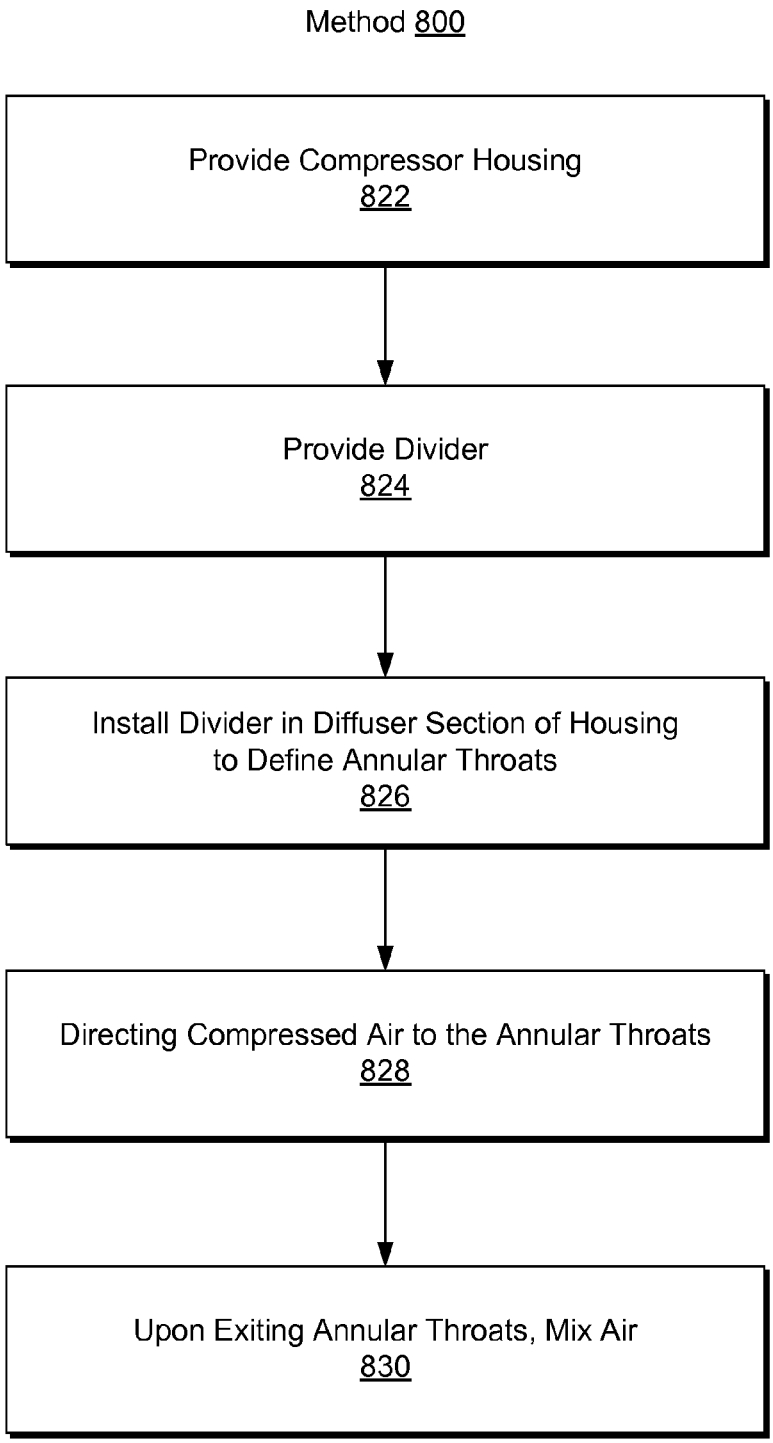
FIG. 8 is a block diagram of an example of a method that includes defining annular throat in a diffuser section of a compressor housing.

FIG. 8 shows an example of a method 800 that includes defining annular throats in a diffuser section. The method 800 includes a provision block 822 for providing a compressor housing (e.g., optionally as multiple components), a provision block 824 for providing a divider, and an installation block 826 for installing the divider in a diffuser section of the housing to define annular throats (e.g., installing the divider onto one or more components, assembling components, etc.). Once installed, the method 800 may include a direction block 828 for directing compressed air to the annular throats (e.g., by rotating a dual faced compressor wheel) and a mix block 830 for, upon exiting the annular throats, mixing the air directed through the throats. Such a method may further include directing air to a volute and subsequently to an intake of an internal combustion engine (e.g., optionally where exhaust drives a turbine to rotate a dual faced compressor wheel housed by the compressor housing).

Figure 9:
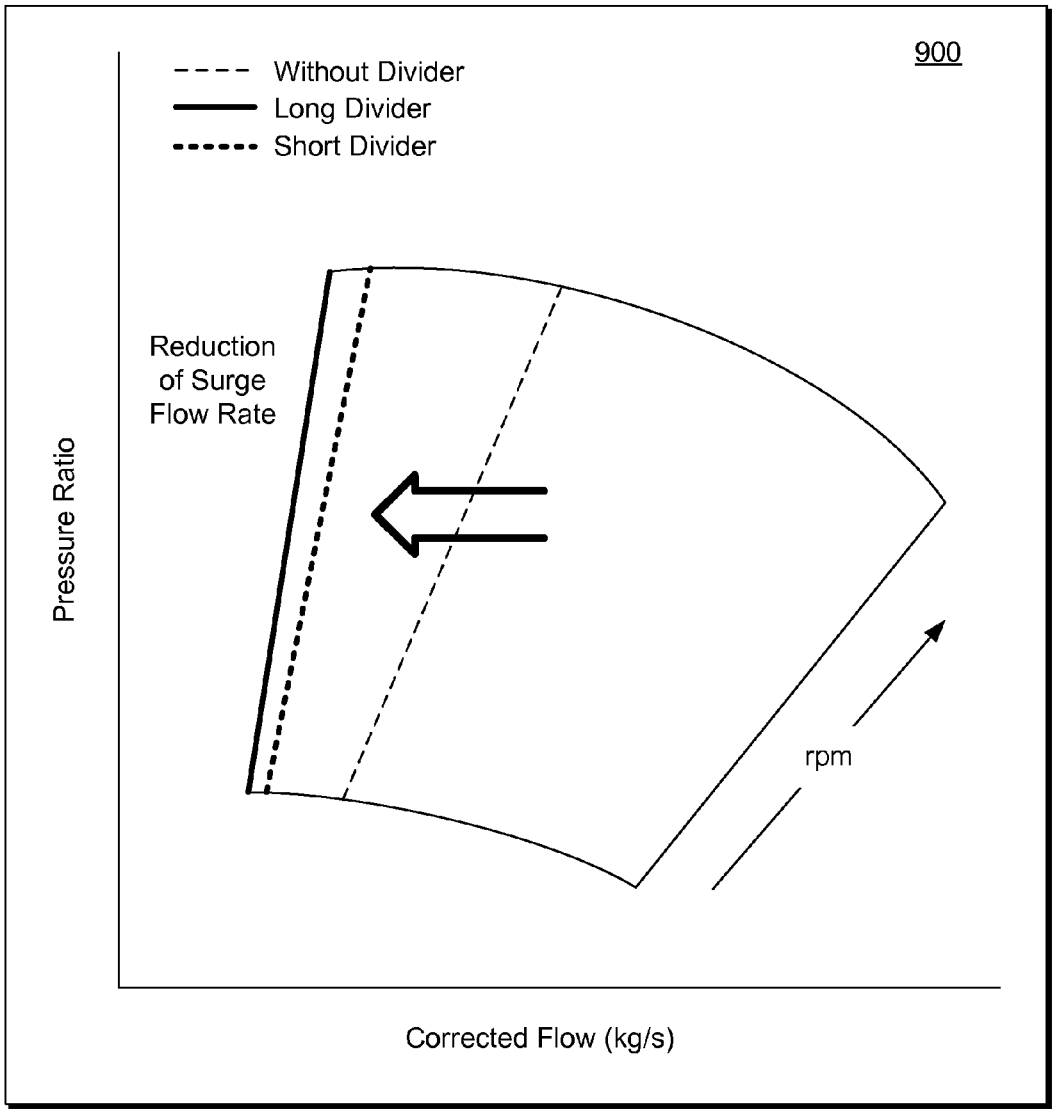
FIG. 9 is an example of a compressor map for a compressor assembly without a diffuser divider and with two different diffuser dividers.

FIG. 9 shows a plot 900 based on trial data for a compressor assembly without a divider (thin dashed line), a compressor assembly with a short divider (thick dashed line) and a compressor assembly with a long divider (thick solid line). As shown, the trial data indicates that a divider can allow for a reduction of surge flow rate. In other words, a divider can move the surge line of a compressor map towards lower flow rates. Accordingly, through use of a divider, lower flow rates may occur with reduced risk of surge.

As described herein, a method can include providing annular throats in a diffuser section of a housing that accommodates two compressor wheel faces; directing air compressed by each of the compressor wheel faces to a respective one of the annular throats; and upon exiting the annular throats, mixing the air directed to the annular throats. In such a method, the directing air to the annular throats can delay compressor surge, for example, compared to a diffuser section with a single annular throat. As described herein, a method may include rotating a single compressor wheel that includes two compressor wheel faces.

As described herein, various acts may be performed by a controller (see, e.g., the controller 190 of FIG. 1), which may be a programmable control configured to operate according to instructions. As described herein, one or more computer-readable media may include processor-executable instructions to instruct a computer (e.g., controller or other computing device) to perform one or more acts described herein. A computer-readable medium may be a storage medium (e.g., a device such as a memory chip, memory card, storage disk, etc.). A controller may be able to access such a storage medium (e.g., via a wired or wireless interface) and load information (e.g., instructions and/or other information) into memory (see, e.g., the memory 194 of FIG. 1). As described herein, a controller may be an engine control unit (ECU) or other control unit. Such a controller may optionally be programmed to control flow of air, exhaust, etc., to one or more wheels or wheel faces (e.g., optionally via adjustable vanes, nozzles, etc.).

Although some examples of methods, devices, systems, arrangements, etc., have been illustrated in the accompanying Drawings and described in the foregoing Detailed Description, it will be understood that the example embodiments disclosed are not limiting, but are capable of numerous rearrangements, modifications and substitutions without departing from the spirit set forth and defined by the following claims.

What is claimed is:

1. A disc comprising:

a central axis;

a leading edge disposed at an inner radius about the central axis;

a trailing edge disposed at an outer radius about the central axis;

an upper surface disposed between the leading edge and the trailing edge;

a lower surface disposed between the leading edge and the trailing edge; and one or more mounting features configured to mount the disc in a diffuser section configured to receive air compressed by two compressor wheel faces and to direct the compressed air to a volute wherein the one or more mounting features comprise one or more openings.

2. The disc of claim 1 wherein the leading edge profile comprises a curved profile.

3. The disc of claim 1 wherein the trailing edge profile comprises a tapered profile.

4. The disc of claim 1 wherein the upper surface and the lower surface comprise substantially parallel surfaces.

5. The disc of claim 1 wherein an axial distance between the upper surface and the lower surface decreases with respect to increasing radial position.

6. The disc of claim 1 wherein the one or more openings comprise axial openings disposed unevenly about the central axis.

7. The disc of claim 1 wherein the trailing edge defines a mixing boundary for mixing of air pressurized by a first compressor wheel face and air pressurized by a second compressor wheel face.

8. The disc of claim 1 further comprising one or more spacers to axially space the disc in a diffuser section.

9. An assembly comprising:

a disc that comprises a central axis, a leading edge disposed at an inner radius about the central axis, a trailing edge disposed at an outer radius about the central axis, an upper surface disposed between the leading edge and the trailing edge, a lower surface disposed between the leading edge and the trailing edge;

a diffuser wall extending between a compressor wheel shroud wall and a volute wall; and one or more mounting components to mount the disc an axial distance from the diffuser wall wherein the disc comprises openings, wherein the one or more mounting components comprise bolts, and wherein the diffuser wall comprises openings, each opening configured to receive a respective bolt.

10. The assembly of claim 9 wherein the openings of the disc are spaced unevenly about the central axis.

11. The assembly of claim 9 further comprising spacers configured to space the disc the axial distance from the diffuser wall.

12. The assembly of claim 9 further comprising a second diffuser wall.

13. The assembly of claim 12 wherein the upper surface of the disc and the diffuser wall define a first throat and wherein the lower surface of the disc and the second diffuser wall define a second throat.

14. The assembly of claim 13 wherein the first throat is configured to receive air compressed by a first compressor wheel face and wherein the second throat is configured to receive air compressed by a second compressor wheel face.

15. The assembly of claim 14 further comprising a compressor wheel that comprises the first compressor wheel face and the second compressor wheel face.

16. A method comprising:

providing a disc mounted in a diffuser section of a housing that accommodates two compressor wheel faces to form annular throats in the diffuser section wherein the disc comprises a central axis, a leading edge disposed at an inner radius about the central axis, a trailing edge disposed at an outer radius about the central axis, an upper surface disposed between the leading edge and the trailing edge, a lower surface disposed between the leading edge and the trailing edge, and one or more mounting features that mount the disc in the diffuser section wherein the diffuser section receives air compressed by the two compressor wheel faces and direct the compressed air to a volute wherein the one or more mounting features comprise one or more openings;

directing air compressed by each of the compressor wheel faces to a respective one of the annular throats; and upon exiting the annular throats, mixing the air directed to the annular throats.

17. The method of claim 16 wherein the directing air to the annular throats delays compressor surge, compared to a diffuser section with a single annular throat.

18. The method of claim 16 wherein a single compressor wheel comprises the two compressor wheel faces.

19. A disc comprising:

a central axis;

a leading edge disposed at an inner radius about the central axis;

a trailing edge disposed at an outer radius about the central axis;

an upper surface disposed between the leading edge and the trailing edge;

a lower surface disposed between the leading edge and the trailing edge wherein an axial distance between the upper surface and the lower surface decreases with respect to increasing radial position; and one or more mounting features configured to mount the disc in a diffuser section configured to receive air compressed by two compressor wheel faces and to direct the compressed air to a volute.

* * * * *